US006027419A

United States Patent [19]

McMahon

[11] Patent Number: 6,027,419

[45] Date of Patent: Feb. 22, 2000

[54] METHOD OF TENSIONING THE STRINGS IN A RACQUET

[75] Inventor: Marshal McMahon, Monaco Ville, Monaco

[73] Assignee: Cogito Holdings Limited, Jersey, Channel Islands

[21] Appl. No.: 08/750,029

[22] PCT Filed: May 25, 1995

[86] PCT No.: PCT/AU95/00304

§ 371 Date: Feb. 24, 1997

§ 102(e) Date: Feb. 24, 1997

[87] PCT Pub. No.: WO95/32030

PCT Pub. Date: Nov. 30, 1995

[30] Foreign Application Priority Data

| | | | |
|---|---|---|---|
| May 25, 1994 | [AU] | Australia | PM5833 |
| Sep. 9, 1994 | [AU] | Australia | PM8022 |
| Jan. 24, 1995 | [AU] | Australia | PN0738 |

[51] Int. Cl.[7] ..... A63B 51/00

[52] U.S. Cl. ..... 473/534; 473/539; 473/540

[58] Field of Search ..... 473/534, 539, 473/540, 543, FOR 178; 24/533, 129, 130

[56] References Cited

U.S. PATENT DOCUMENTS

| | | | |
|---|---|---|---|
| 3,891,211 | 6/1975 | Diefenbach . | |
| 3,912,267 | 10/1975 | Lyon . | |
| 3,966,207 | 6/1976 | Pass . | |
| 4,052,060 | 10/1977 | Balkcom . | |
| 4,077,627 | 3/1978 | Cheatham et al. . | |
| 4,118,029 | 10/1978 | Septier | 473/534 |
| 4,140,316 | 2/1979 | Coupar . | |
| 4,149,722 | 4/1979 | Yager . | |
| 4,185,822 | 1/1980 | Li . | |
| 4,309,033 | 1/1982 | Parker, Jr. et al. | 473/540 |
| 4,320,900 | 3/1982 | Blackburne | 473/533 |
| 4,330,132 | 5/1982 | Ferrari . | |
| 4,333,649 | 6/1982 | Vaughn et al. | 473/540 |
| 4,373,463 | 2/1983 | Beaudette | 24/129 |
| 4,417,729 | 11/1983 | Morrone | 473/556 |
| 4,570,933 | 2/1986 | Michiels | 473/539 |
| 4,593,905 | 6/1986 | Abel | 473/534 |
| 4,741,531 | 5/1988 | Szedressy . | |
| 4,750,742 | 6/1988 | Coupar . | |
| 4,928,963 | 5/1990 | Garbosch . | |
| 5,141,227 | 8/1992 | Flamm | 473/543 |
| 5,186,459 | 2/1993 | Korte-jungermann | 473/539 |
| 5,346,211 | 9/1994 | Ou et al. | 473/540 |
| 5,522,120 | 6/1996 | Brinning | 24/130 |
| 5,675,872 | 10/1997 | Emery | 473/539 X |

FOREIGN PATENT DOCUMENTS

| | | | |
|---|---|---|---|
| 18363/34 | 9/1935 | Australia . | |
| 125055 | 8/1947 | Australia . | |
| 20475/70 | 12/1973 | Australia . | |
| B1-20525/76 | 9/1979 | Australia . | |
| B1-11154/76 | 12/1979 | Australia . | |
| 524398 | 9/1982 | Australia . | |
| 28765/84 | 3/1984 | Australia . | |
| 539933 | 10/1984 | Australia . | |
| 50041 | 3/1935 | Denmark | 473/FOR 178 |
| 582861 | 10/1924 | France | 473/FOR 178 |
| 3506025 | 8/1986 | Germany | 473/FOR 178 |
| 23260 | 10/1908 | United Kingdom | 473/FOR 178 |
| 137366 | 1/1920 | United Kingdom . | |
| 175571 | 2/1922 | United Kingdom . | |
| 417748 | 10/1934 | United Kingdom . | |
| 451384 | 8/1936 | United Kingdom | 473/FOR 178 |
| 566130 | 5/1945 | United Kingdom . | |
| 887526 | 1/1962 | United Kingdom | 473/FOR 178 |
| 1 201 649 | 8/1970 | United Kingdom . | |
| 1 481 640 | 8/1977 | United Kingdom . | |

*Primary Examiner*—Raleigh W. Chiu

*Attorney, Agent, or Firm*—Kelly Bauersfeld; Lowry & Kelley, LLP

[57] ABSTRACT

A method of stringing a racquet includes independently tensioning a plurality of strings in the racquet and maintaining the independent tensioning. Individual strings are held and their tensioning maintained using cleats and grommets. In this fashion, the elastic properties of the shorter strings may be matched to that of the longer strings, giving a larger sweet spot. The strings may be manufactured as a pre-woven mesh.

36 Claims, 10 Drawing Sheets

METHOD OF TENSIONING THE STRINGS IN A RACQUET

The present invention relates generally to improvements in sporting racquets and, more particularly, but not exclusively, to improvements in methods of stringing racquets, sporting racquets with improved stringing and tools and machines for stringing and improving the stringing of sporting racquets.

Currently available sporting racquets, for example tennis racquets, are continuously strung by passing a length of stringing material through holes in a frame, pulling the length of stringing material to a predetermined pressure and tying it off under pressure against itself. The pressure is retained within the length of stringing material. Conventionally, a single length of stringing material forms strings which run length-wise in the racquet head and a separate single length of stringing material forms strings which run cross-wise.

Because of this stringing method, the tension of each string in the racquet (the term "string" being used herein to mean one string "span" from one side of the racquet head to the other, and not the total length of stringing material) is substantially similar across the entire racquet face (the term "racquet face" being used herein to mean the strung area of the racquet head). The "elastic quality" of a tensioned string depends upon the tension applied and the length of the string. The amount of "elastic bend back" experienced by a relatively long string in a conventional racquet head when an object is struck will be greater than that available to the shorter strings in the racquet because all the strings are at substantially similar tension i.e., the elastic properties vary in dependence on the length of the string. This can have a deleterious effect on shot playing. For example, it is well known that in tennis it is desirable to strike the ball at the centre area of the racquet face, to ensure that the ball travels in the desired direction with the desired power. At the centre area of the face of a conventionally strung tennis racquet the strings will have similar elastic properties, by virtue of the fact that the length differences between strings are at a minimum. This centre area is generally known as the "sweet spot".

At the outer area of the racquet face the shorter and longer strings will have different elastic properties. It is well known that control and power applied by the outer area of the racquet face of a conventional tennis racquet is extremely unreliable. Hence the desirability of striking a ball with the centre of the racquet face.

Even towards the centre of the racquet face in the so-called "sweet spot", the elastic properties of the strings vary somewhat.

In presently available sporting racquets, therefore, a perfect sweet spot does not exist and the nearest approximation to a sweet spot is located in a small area, generally towards the centre of the racquet face.

From a first aspect, the present invention provides a method of stringing a racquet, comprising the steps of independently tensioning at least a plurality of strings in the racquet and applying means for maintaining the independent tensioning.

By "independently tensioning" is meant the application of tension independently to each string of at least the plurality of strings.

The plurality of strings are preferably independently tensioned to different tensions and the resultant differential pressures between strings maintained.

Preferably, all strings in the racquet will be independently tensioned, although embodiments are envisaged where some of the strings may be strung by prior art methods and the others independently tensioned.

In at least preferred embodiments, the ability to independently tension strings to different tensions and maintain the resultant differential pressures between strings can result in vast improvements in racquet quality. It is possible to provide a racquet face where the elastic quality is substantially even over the entire face. In other words, it is possible to provide a racquet which has a "sweet spot" across substantially the entire racquet face.

The ability to individually control tension also allows "zoning" of the racquet face. Different areas of the racquet face may display different qualities.

It is also possible to use different gauge and/or material strings in different areas of the racquet face to assist variation or provide further variation in racquet characteristics.

A "sweet spot" over the entire area of a racquet will generally be achieved by having the tension in the longest strings the greatest, stepping down the tension for shorter strings. For example, where the tension in the longest strings (the base tension) is 28 kg, then the tension in the shorter strings is set lower, say 26, 24, 22, 18 etc., depending upon their relative length with respect to the length of the longest string. We have found that stepping down, or providing differential tensions between the strings in this manner provides the best method of obtaining even elastic quality over the entire surface of the racquet.

From a second aspect, the present invention provides a method of stringing a racquet, comprising the step of tensioning at least a plurality of strings in the racquet in accordance with the following formula:

$$T_s = \left(\frac{L_s}{L_L}\right)^P T_L$$

wherein, $T_s$ is the tension to be applied to the particular string being tensioned, $L_s$ is the length of the particular string being tensioned, $L_L$ is the length of the longest string in the racquet, $T_L$ is the tension of the longest string in the racquet which is preset as the standard or base tension and P is in the range 1.7 to 2.3 inclusive.

In one preferred embodiment, P=2.

We have found that tensioning strings in accordance with this formula leads to elastic quality of the strings so tensioned being substantially similar. Where all the strings on a racquet are tensioned in this manner, this, in at least preferred embodiments, leads to a "sweet spot" over substantially the entire face of the racquet.

P=2.3 has also been used with good effect. P in the range 1.7 and 2.3 may be used to provide racquets of good quality, in at least preferred embodiments.

The length of each string L, is preferably measured between the inside faces of the racquet frame, in each case.

It will be appreciated that other formulas may be devised and applied to provide racquets with different characteristics.

From a third aspect, the present invention provides a method of stringing a racquet, comprising the step of applying tension to at least a plurality of strings in the racquet so that the elastic quality of a plurality of the shorter strings substantially matches the elastic quality of a plurality of the longer strings.

As discussed above, where the elastic quality of shorter and longer strings in a racquet substantially matches, then the elastic bend back response of the racquet will be substantially even across the face of the racquet, providing more precise control/power characteristics over the racquet face than available in conventional, prior art racquets.

From a fourth aspect, the present invention provides a method of stringing a racquet, comprising the step of tensioning at least a plurality of the strings to a predetermined level so that at least a plurality of strings retain different, pre-calculated tensions, in order to provide predetermined elastic qualities for the strings, whereby to produce racquets having predetermined qualities.

Preferably, the pre-calculated tensions are calculated to provide predetermined racquet characteristics, i.e., power, spin and direction of shot provided by racquet. As discussed above, it is possible to individually tension the racquet strings to tensions which are calculated to provide a sweet-spot over the entire racquet face.

As also discussed above, any characteristic may be applied in accordance with this method. For example, different areas of the racquet may have different qualities i.e., some may be more useful for applying spin, some more useful for applying power and direction, depending generally upon the elastic properties of a particular area.

From a fifth aspect, the present invention provides a method of stringing a racquet, comprising the steps of tensioning at least a plurality of strings against a holding means associated with the racquet, by individually adjusting the tension in each of the plurality of strings to a predetermined level, by applying more or less pressure to each individual string with respect to the holding means, and when the string has been adjusted to the predetermined tension level, locking the string with respect to the holding means, so that the string is held at a predetermined tension level against the holding means.

Preferably, the plurality of strings is tensioned so that they have different tensions from each other, and the holding means is arranged to maintain the difference in tension (differential pressure between strings). The strings may be individually strung, i.e., one string for each string travel across the face of the racquet, or continuously strung as in the prior art, i.e., a single length of stringing material forming a plurality of string spans across the face of the racquet.

By "adjusting the tension" is meant the calibration action of making the tension greater or lesser in a string until arriving at a predetermined tension. In preferred embodiments, this will mean stretching or relaxing the string with respect to the position of the holding means which will generally be stationary with respect to the racquet frame. A calibration tool (see later) may be utilised to adjust the tension in the strings.

In one preferred embodiment, the holding means comprises a plurality of cleats. Preferably, each individual string is held between a pair of cleats. The cleats are preferably seated within the racquet frame, within a grommet strip which extends into the string holes and mounts the cleats. In an alternative embodiment, each cleat is provided with a plurality of projections which extend outwardly to maintain the position of the cleat within the string hole.

The cleat has teeth which narrow downwardly from a relatively wide opening. A string is passed through the opening, adjusted to tension and then locked with respect to the cleat by being pushed downwardly towards the narrow part of the cleat teeth.

By utilising a pair of cleats at opposite sides of the racquet frame to adjust the tension of a string extending between the pair of cleats, it is possible to apply "individual stringing", i.e., a single length of stringing material for each of the plurality of strings. In one embodiment of the present invention, after the string has been tensioned and locked between a pair of cleats, a "tail", or length of string is left projecting from one or both of the pair of cleats, outwardly of the racquet frame. This tail enables subsequent re-adjustment of the tension in the string, as required. Preferably, the tail or tails will be protected by a removable cover extending about the frame of the racquet.

Further, mounting a string between a pair of cleats allows the application of tension to the string from either end, and not just from one end of the string as in the prior art. In the prior art, the tension tends to be greater towards the end of the string where tension has been applied and lesser towards the end where tension is not applied. By applying tension to either end of the string, this tension differential along the length of the string is minimised. It will be appreciated that it is possible to apply tension from one end of the string only, if required.

In a preferred embodiment a pair of cleats is provided for each string in the racquet, allowing the tension for all strings in the racquet to be individually adjusted.

In an alternative embodiment, the holding means comprises a locking cross-section grommet strip associated with the frame of the racquet, into which the strings may be locked. In particular, the grommet strip preferably comprises a strip having a "V" cross-section slot running lengthwise of the strip. The "V" section slot preferably extends substantially between adjacent string holes on the outer surface of the racquet frame. In a preferred method utilising this particular holding means, continuous stringing is employed. The tension in a first string is adjusted to the required level and then the string length at the end of the string is passed into the "V" section grommet strip, through the adjacent string hole and across to the other side of the racquet to form the adjacent string. The "V" section grommet strip maintains the differential pressure between the first string and the adjacent string, by virtue of gripping the string length and preventing it from sliding back under tension. The "V" section groove may be toothed or serrated.

A further alternative embodiment utilises high-friction pads against which the tension of individual strings may be maintained, preferably in a continuously strung racquet. The method of utilising high-friction pads as the holding means is similar to the method employed utilising the "V" section grommet strip. Each high-friction pad essentially acts to maintain a differential pressure between adjacent strings in the racquet. High friction pads could be incorporated into the grommet strip or could be part of a continuous grommet strip.

Alternative embodiments may utilise metal inserts inserted in a grommet strip in order to grip the strings. The metal inserts may be toothed or serrated.

A further alternative is to have the grommet strip comprised of a high friction material where the string has to be gripped and a low frictional material where the grommet passes into the string hole in the frame.

In a further alternative, a continuous grommet strip of high friction material is used to maintain differential pressure between strings in a continuously strung racquet. The strings contact the high frictional material where they extend on the outer surface of the frame and are substantially prevented from slipping back under tension by the resistance provided by the high frictional material of the grommet strip.

Note that in the grommet strip and high-friction pad method tension of a string may slip back somewhat when the length of string is being manipulated to form adjacent strings. This should preferably be taken into account when considering the tension level to initially adjust the string to.

For example, in some cases it may be prudent to adjust the tension to a level somewhat higher than the predetermined tension level required, to take "slip back" during stringing into account.

In a further alternative, the holding means may comprise a combination of the embodiments discussed above e.g., combination of cleats and modified grommet strip is one frame.

In a further alternative embodiment, the holding means preferably comprises a racquet frame which is manufactured directly onto strings which have been pre-tensioned to provide the desired racquet characteristics. The racquet frame itself therefore locks the strings within the frame and maintains the predetermined tension.

Note that it is accepted that with the present invention, as with conventional racquets, tension of the strings is likely to reduce overtime and as the racquet is used in play. All the statements given above and below defining the alternative aspects of this invention should be read with this in mind. In at least some embodiments of the present invention, it is possible to readjust the tension of the strings. In particular, in the cleat embodiment where adjustment of tension is possible by removing the string from the cleat or cleats, re-tensioning and reapplying to the cleats. Restringing is also possible in some embodiments, as with conventional racquets.

Note that in an alternative embodiment, a locking cross-section groove or high friction surface may in fact be an integral part of the racquet frame and not formed within or by a separate grommet strip.

Further, in the cleat embodiment, rather than the cleat being a separate body mounted with respect to the racquet frame, it is also envisaged that cleats could be formed integrally with the racquet frame. This would be particularly suited to racquets of graphite and aluminum.

In any of the aspects of the invention discussed above and below, strings may be individually tensioned to provide predetermined characteristics for the racquet. Tensioning may be applied so that the elastic properties are uniform over the face of the racquet, providing a sweet spot over the entire face, or may be applied to provide varying characteristics over the face of the racquet, e.g., one area may provide a power zone, another area a spin zone, etc. Further, string gauges and material types may be varied within a single racquet head in order to assist in providing predetermined qualities for the racquet. Further, the racquet may be strung by a mixture of continuous stringing and individual stringing, individual stringing only or continuous stringing only, again to assist with variation in the racquet characteristics.

It should be noted that throughout the specification and claims the term "racquet" should also be taken to cover racquet heads which may be manufactured separately from a shaft to be subsequently married with a shaft to provide the complete racquet. The present invention includes within its scope replacement racquet heads which are removable from the racquet shaft.

From a sixth aspect, the present invention provides a sports racquet, strung in accordance with the method of any of the aspects discussed above.

The racquet in accordance with this aspect of the invention may be strung in accordance with any of the techniques discussed above.

From a seventh aspect, the present invention further provides a sports racquet frame, including a holding means, arranged to enable individual adjustment of the tension in each of a plurality of racquet strings to a predetermined level and to lock each string with respect to the holding means so that each string is held at the predetermined tension level against the holding means.

The holding means may comprise a plurality of cleats into which the strings may be locked, a racquet frame formed onto pre-tensioned strings, a locking cross-section grommet strip around the frame of the racquet into which the string may be locked, a plurality of high-friction pads against which the tension of individual strings may be maintained, a length of high friction material, or any of the other "holding means" discussed above.

From an eighth aspect, the present invention further provides a miniature cleat for mounting with respect to a racquet frame and arranged to hold a string in the racquet frame at a predetermined tension.

This cleat may be used in the method and racquet discussed above for maintaining string tension in the racquet. All or most cleat designs may be used, including all the jamming varieties, V jam, rocker types, angle jam, cam action cleats, etc.

A preferred cleat type is a V jam type including a plurality of teeth which are, in use, angled outwardly against the pressure exerted by the string.

The cleats are preferably mounted within a grommet strip which extends around the racquet frame. The grommet strip may not be an entire strip, but a plurality of separate grommets, e.g., one grommet associated with each hole.

The cleats may be provided with protrusions on their outer surface which assist in retaining the cleat within the grommet strip.

From an ninth aspect, the present invention provides a grommet strip mounting a plurality of miniature cleats, the cleats being in accordance with the preceding aspect of the invention.

The present invention yet further provides a kit-of-parts, comprising a plurality of miniature cleats as discussed above and a grommet strip for mounting the cleats with respect to a racquet frame so that the cleats may be arranged to apply and maintain a predetermined tension to racquet strings.

The present invention yet further provides a grommet strip, for use with a racquet frame and including a locking cross-section groove to independently hold at least a plurality of racquet strings at predetermined tensions.

The locking cross-section groove is preferably arranged to maintain a differential pressure between adjacent strings in a continuously strung plurality of strings.

The present invention, in at least preferred embodiments, provides the ability to individually tension each string of a plurality of strings in a sporting racquet to different tensions and to maintain the different tensions between strings. For at least some embodiments, this enables the use of pre-woven string sets (comprising a plurality of interwoven lengths of stringing material—one length for each string) for racquet stringing, as the strings no longer have to be continuously strung as it is possible (in at least some embodiments) to have a single length of stringing material comprising each string span across the face of a racquet (independent stringing).

In a method of manufacturing a racquet in accordance with the present invention utilising a pre-woven string set, the string set is placed within a racquet head with the individual ends of strings extending through the string holes in the racquet frame. Tension is then applied in a predetermined manner to each string and maintained by holding means, preferably cleats.

In one alternative embodiment, predetermined tensions will be applied to individual strings in a string set and a racquet frame moulded to hold the strings at the predetermined tension.

The strings may be tensioned by being pulled from either end, in order to reduce variability across the length of the string (see above), or may be tensioned by pulling from one end.

From a further aspect, the present invention provides a method of manufacturing a pre-woven string mesh for sporting racquets, comprising weaving a plurality of strings together in a weaving loom, in a continuous stream, applying securing means to hold the weave in position, and cutting the weave to a shape to fit into a racquet head.

The securing means preferably comprises webbing, preferably plastics webbing, applied to each face of the weave. A low tack adhesive sheet or self adhesive film may be used as the webbing.

The present invention yet further provides a pre-woven string mesh for sporting racquets, comprising a plurality of strings woven together and guillotined to a racquet shape, and maintained in position by a securing means comprising webbing applied to each face of the weave.

In prior art stringing methods, which employ continuous stringing, it has previously been necessary to provide bracing for the top and bottom, left and right sides of the racquet frame, in order to prevent the frame imploding during the stringing operation, i.e., if all the vertical strings are strung before any of the horizontal strings, the pressure on the racquet is likely to be so great as to cause the racquet to implode in the vertical direction.

The ability to independently apply tension to each string in the racquet and/or to independently string the racquet, in accordance with aspects of the present invention, means it is possible to provide a stringing method which requires no bracing of the racquet frame. The strings may be tensioned in the order which creates the least stress on the racquet frame.

By choosing a suitable order for tensioning the strings, bracing means to support the racquet frame during stringing can be avoided. This is particularly convenient for individually strung racquets.

In some racquet embodiments, racquets may be specially marked to indicate in what order the stringing tool needs to be applied to the strings in order to tension them.

A further problem with prior art continuous stringing techniques is that it is necessary to manufacture the racquet frame so that portions of the frame are stronger than other portions, i.e., "strong zones" of the frame are provided, in order to support the stresses produced by the continuous stringing to even tension for all strings.

In the present invention, because it is possible to individually tension strings, it is possible to dispense with at least some of the strength zones in the racquet frame, particularly where a racquet is strung such that only the longer strings are tensioned to high pressures.

From a further aspect, therefore, the present invention provides a racquet, the frame being designed to support stringing strung in accordance with the present invention and dispensing with or varying the position/strength of at least some strength zones in the frame.

The frame may be altered to produce different playing characteristics in the frame. Weight may be loaded in different parts of the frame, depending upon player preference or to provide particular characteristics to the frame. Tension of the strings can be individually adjusted to take into account the weight distribution in the frame.

As discussed above, different pressure patterns in stringing may be applied in accordance with the present invention. The invention also envisages the production of a racquet frame structure which is designed in accordance with pressure patterns to be utilised in stringing. That is, strengths and weaknesses in the frame may be designed to accord with amount of pressure provided by particular areas of the pressure pattern.

In continuously strung prior art racquets, the general stringing technique involves stringing with a single continuous length of stringing material, or two continuous lengths of stringing material (one for the verticals and one for the horizontals), then tying off the individual length of stringing material under pressure, so that the pressure on the individual strings is exerted against the continuous string itself.

Apart from the problem that all the strings in such a racquet are under the same tension and therefore the characteristics provided by the racquet are not ideal, there is a further problem, in that on tying off the continuous string much of the tension which has been applied to the later tensioned strings during stringing is lost (upwards of 30% of the applied tension may be lost during tying off). In order to maintain sufficient tension in the later tensioned strings, therefore, it is necessary to over-tension some strings past the base tension required and predict the drop off in pressure due to tying off, in the hope of achieving the correct pressure in the string.

From yet a further aspect, the present invention provides a method of securing the strings of a racquet, by locking the string or strings within a locking member which secures the string and allows minimal drop-off in tension during the locking process.

Locking means preferably comprises a cleat into which the string can be locked and retained. The cleat is preferably mounted with respect to the racquet frame, preferably within the racquet frame in a string hole.

Where a racquet is continuously strung, only a single, or a pair of cleats will be required (where the horizontal and vertical strings are formed from one length of string), or three or four cleats where the vertical and horizontal are strung by separate string lengths.

In this aspect of the invention, the strings will be pulled to pressure and locked within the cleat(s).

This aspect of the invention has the advantage that, in at least preferred embodiments the amount of pressure lost during the locking step is much less than that lost during a tying off step as used in the prior art.

The ability to individually string in accordance with the present invention (i.e., not continuously string, but have individual string lengths for at least a plurality of racquets strings), also allows different coloured strings to be used for each string. A racquet may thus be designed with a surface pattern. This could be used for sponsorship, advertising, etc. From yet a further aspect, the present invention provides a method of presenting information, comprising the step of stringing a sporting racquet with individual string lengths, each string being marked so that the individual string lengths together form a predetermined pattern on the face of the racquet, whereby the pattern may present advertising, sponsorship, etc.

The present invention from yet a further aspect provides a racquet strung in accordance with the above aspect of the invention.

Features and advantages of the present invention will become apparent from the following description of embodiments thereof, by way of example only, with reference to the accompanying drawings, in which:

FIGS. 1 to 3 illustrate a racquet frame construction in accordance with an embodiment of the present invention which enables racquets to be strung in accordance with the present invention, by allowing independent tensioning of each of at least a plurality of strings in the racquet.

The figures disclose a portion of a racquet head frame 1, the portion having formed therein a string hole 2, through which it is intended that a racquet string is to be passed and held.

Figure 1:
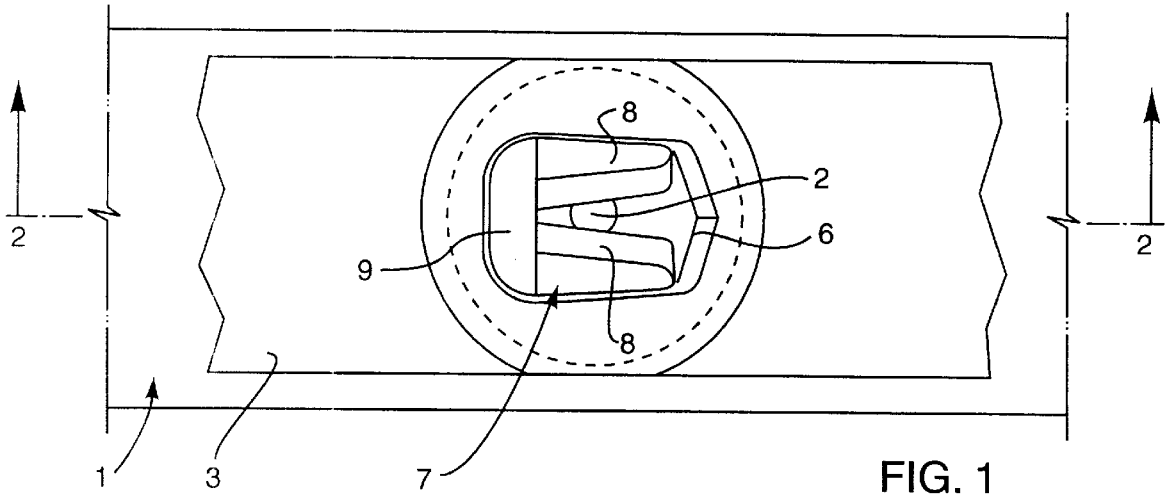
FIG. 1 is a top view of a portion of a racquet frame in accordance with an embodiment of the invention.

It will be appreciated that the entire racquet frame may be of any conventional racquet shape, and may be formed integrally with a racquet shaft or separately therefrom as an integral racquet head intended for connection to a racquet shaft. The racquet frame will have a plurality of holes therein for receiving strings therethrough. Each string hole 2 of the racquet frame of this embodiment will have the same structure and componentry as disclosed with reference to FIGS. 1 to 3.

A grommet strip 3 is mounted to the outside of the racquet frame and runs entirely around the racquet head. Please note that individual grommet strips running only between adjacent string holes may be used as an alternative.

At each string hole 2, a portion 5 of the grommet strip extends within the string hole 2. The portion 5 is provided with portions 6 which seat the cleat 7 within the string hole in a manner most clearly shown in FIG. 2. The cleat 7 has three sets of teeth 8 leaning forwardly from the base of the cleat 9 towards the outer surface of the racquet frame 1. Four or more teeth may be required to hold lighter tensions.

A further alternative is to have individual "eyelets" for each string hole, supporting a mounting means for mounting a cleat within the hole. The mounting means will be preferably comprise, an eyelet with a portion extending into the string hole, similar to portion 5 of the illustrated grommet strip.

The form of the cleat is clearly shown in FIGS. 4 through 9. The teeth 8 are arranged to narrow in a generally "V" shape, from a mouth 10 to a base 9. A string may be passed into the mouth 10 and "locked" by being moved down the V-shaped cleat towards the base 9 until jammed between the teeth 8. In the preferred embodiment, the cleat 7 is "self-locking". In other words, after the string, passed through the open mouth of the cleat, has been adjusted to tension by a gripping member which holds an end of the string and pulls it to tension, on release of the gripping member the teeth 8 automatically grip the string and the tension of the string causes it to slide into the narrow part of the cleat and lock there. It is not necessary to physically push the string into the narrow part of the cleat, it happens automatically.

This "micro cleat" may be obtained from Clamcleats Limited, Watchmead, Welwyn Garden City, Hertfordshire AL7 1AP, England.

Figure 9:
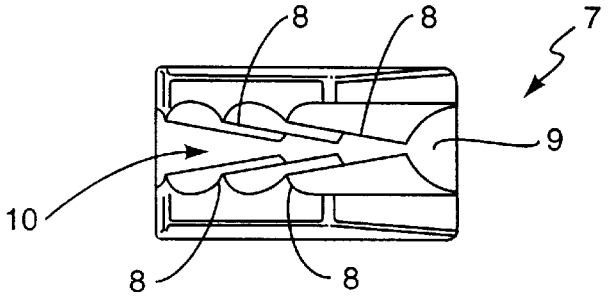
FIG. 9 is a top view of the cleat of FIG. 4.
Figure 9A:
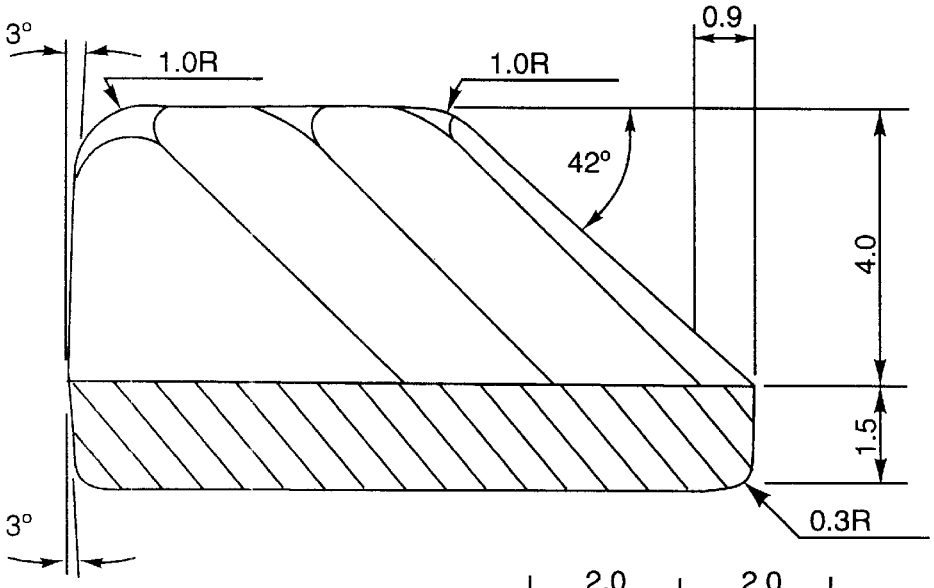
FIG. 9A is a sectional view of the cleat of FIG. 4, illustrating example dimensions and angles.
Figure 9B:
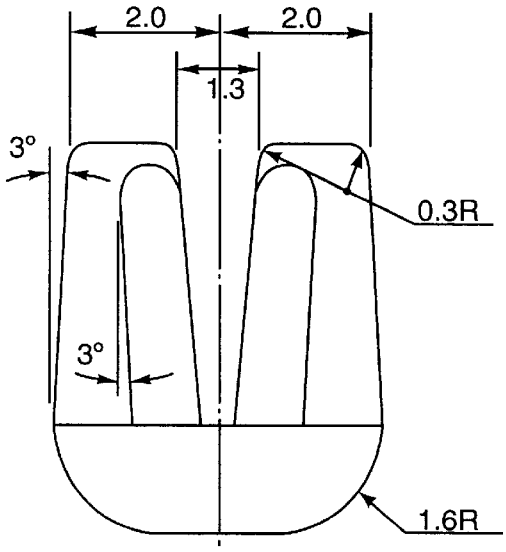
FIG. 9B is a front view of the cleat of FIG. 9*a;*
Figure 9C:
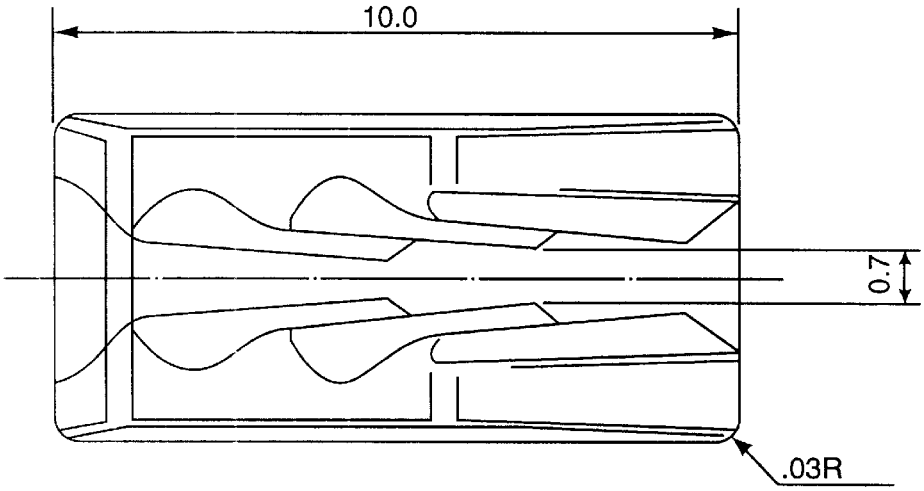
FIG. 9C is a top view of the cleat of FIG. 9*a;*

FIGS. 9A through C show an example of a preferred embodiment of a cleat, showing example dimensions and teeth angle. This example is for the preferred embodiment only. It will be appreciated that dimensions of cleats may be varied, depending upon string sizes, racquet frames, etc.

In the embodiment shown, the cleat has three sets of teeth. The number of teeth may be varied. In particular, where it is necessary to hold a string under a relatively low tension, only two sets or even one set of teeth may be provided. In general, the more teeth, the more tension the cleat is able to hold. It is envisaged that in a single racquet where all the strings are tensioned in this manner, the high-tension (usually longer) strings may be tensioned by cleats with three teeth, and lower tension strings may be held by cleats with lower numbers of teeth.

Figure 2:
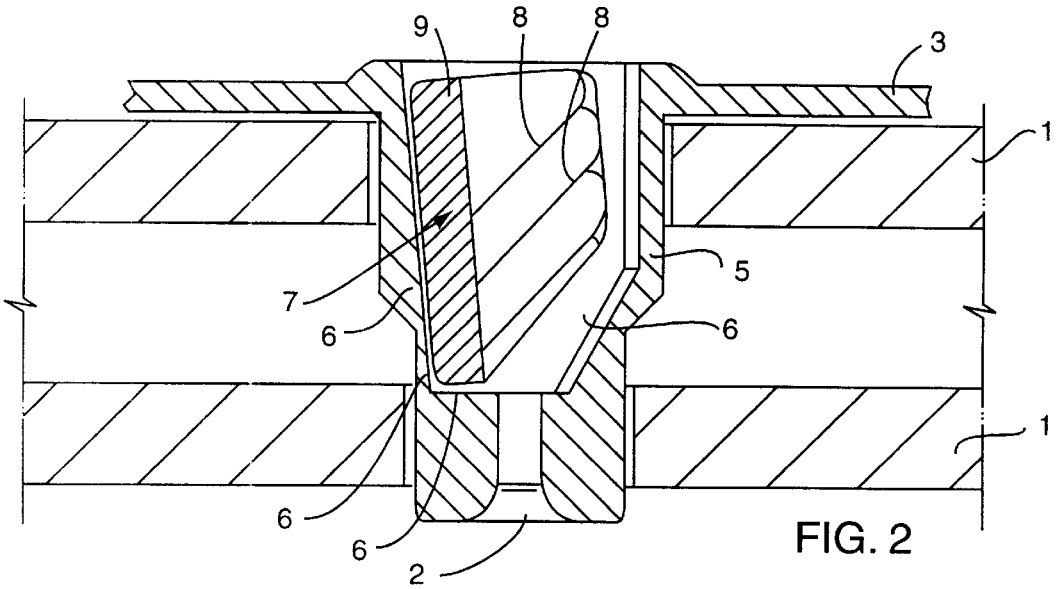
FIG. 2 is a section on 2—2 of FIG. 1.
Figure 3:
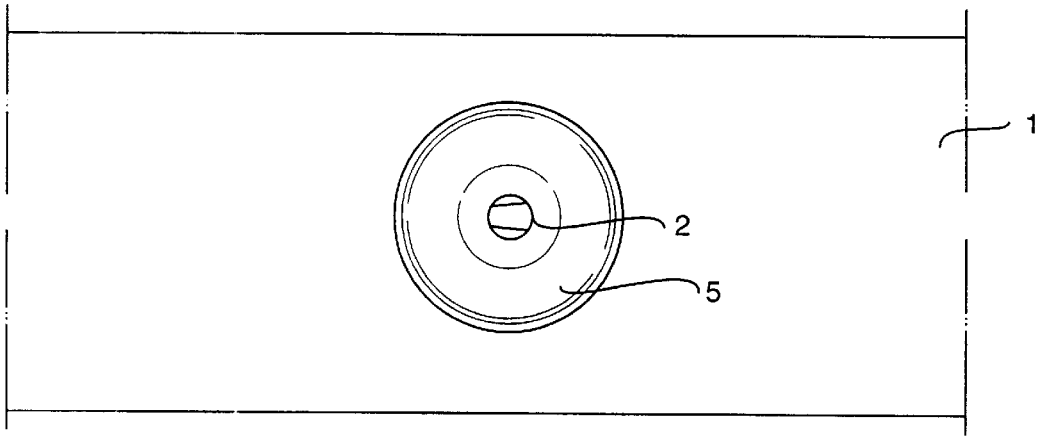
FIG. 3 is a bottom view of the portion of the racquet frame of FIG. 1.
Figure 4:
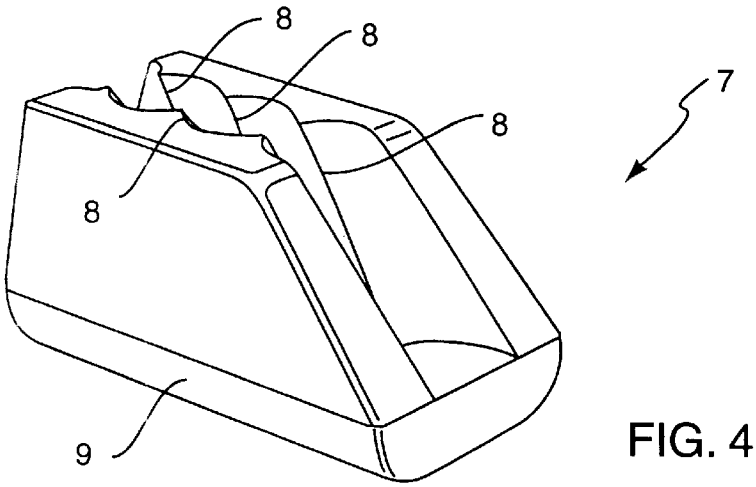
FIG. 4 is a perspective view of a cleat used in the embodiment of FIGS. 1 to 3.
Figure 5:
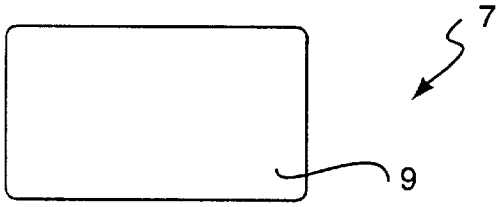
FIG. 5 is a bottom view of the cleat of FIG. 4.
Figure 6:
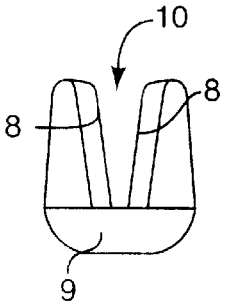
FIG. 6 is a front view of the cleat of FIG. 4.
Figure 7:
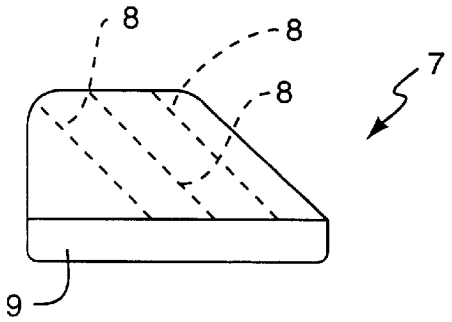
FIG. 7 is a side view from one side of the cleat of FIG. 4.
Figure 8:
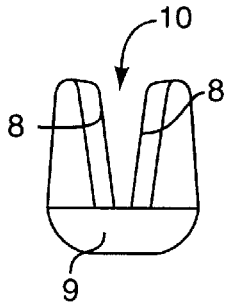
FIG. 8 is a back view of the cleat of FIG. 4.

Each cleat is mounted within the grommet strip as shown in FIG. 2, with the teeth 8 leaning outwardly from the base towards the outside of the racquet frame 1. The cleat 7 is held within portion 6 from the section 5 of the grommet strip 3 which extends within the string hole 2. The grommet strip 3 may be of rigid plastics or other suitably rigid material for maintaining the cleat 7 seated within the hole.

In the preferred embodiment, the portion 5 of the grommet strip will extend downwardly through the string hole to the inner surface of the racquet frame and will form an eyelet about the string hole at the inner surface of the racquet frame. This eyelet prevents the string from rubbing against the racquet frame and being cut by the racquet frame, which can be a particular problem with graphite and other hard-material racquet frames.

Further, in the preferred embodiment, the portion 5 of the grommet strip is slightly hollowed on the side of the open portion of the cleat, to enable the string to be easily passed through the string hole and the mouth of the cleat.

In an alternative embodiment (not shown), the cleat may have projections formed integrally therewith for maintaining the cleat seated in the hole without any grommet strip portion 5.

In a further alternative embodiment, particularly suited for aluminium and graphite racquets, cleats may be integrally formed with the racquet frame itself, i.e., integrally formed within string holes in the racquet frame.

In the preferred embodiment, a cleat is associated with every string hole in the racquet and each string in the racquet is supported and tensioned between a pair of cleats.

In one stringing method, a first end of a string is seated within the first of the pair cleats so that it seats firmly within the teeth 8. The string is passed through the opposite of the pair of cleats and is then pulled to the predetermined tension (preferably taking into account any relaxation which may occur when the tension is released and before the cleat engages and locks the string). When the tension value is obtained, the means gripping and applying the tension to the string is released and the angle of the cleat teeth together with the tension of the string causes the string to be gripped by the teeth and drawn within the jaws and locked there. The teeth are arranged not to cut the surface of the string but in fact to bend the surface of the string. The tension of each string in the racquet can thus be determined and set individually. The teeth may cut the outer surface of the string at times without cutting all the way through—this may happen at the high tension levels.

With this arrangement individual stringing is preferred.

With this arrangement, strings can be independently tensioned to provide predetermined racquet characteristics. Strings may be tensioned in accordance with the formula discussed in the preamble in order to give a racquet having a sweet spot substantially entirely over the surface thereof (where all the strings are tensioned in this manner). Alternatively, the strings may be tensioned to provide predetermined characteristics to predetermined areas of the racquet. The arrangement allows complete flexibility for determining racquet characteristics. Different string gauges, different string materials, etc., may be employed.

In alternative embodiments, as discussed in the preamble, only some of the strings of the racquet may be tensioned using individual holding cleats as illustrated in the figures. Others could be strung by prior art methods. It really depends on what qualities are required for the particular racquet.

The provision of a holding cleat also, in at least preferred embodiments, assists with the problem discussed in the preamble relating to loss of racquet tension due to the necessity to "tie-off" strings, in the prior art. The cleat may be used in a prior art stringing method utilising continuous stringing, but instead of tying off the length of stringing material cleat will be used to retain it. Utilising a cleat will advantageously reduce drop off of tension, even with prior art stringing methods.

Although the cleat illustrated is the preferred type of cleat, it will be appreciated that other types of cleats may be employed.

Further, the cleats need not be seated in the string holes, but could be seated on the outer surface of the racquet frame instead.

Conventional racquets may be adapted by widening the string holes to receive cleats and adding the grommet strip for mounting the cleats.

An alternative method of tensioning the individual strings would be to tension each end of a string at the same time and then lock the string within a pair of cleats. This preferably minimises any variation in tension over the length of the string.

Where a pre-woven string set is provided (see preamble), apparatus may be utilised to tension all strings at the same time.

An alternative holding means for allowing independent tensioning of racquet strings is illustrated in FIGS. 10 through 13. These figures illustrate a locking cross-section grommet strip arranged to be placed around the outside of a racquet frame. The grommet strip comprises a "V" shape trench 20 which runs between adjacent string holes 2 in a racquet frame 1. The grommet strip 21 may be a continuous strip, extending about the entire outer circumference of the racquet frame 1, or it may consist of a number of discrete single strips extending between adjacent holes 2, or discrete strips extending around holes. The locking section grommet strip may, indeed, merely be an eyelet around each string hole. Most preferably, it consists of a single strip extending around the racquet frame.

Figure 10:
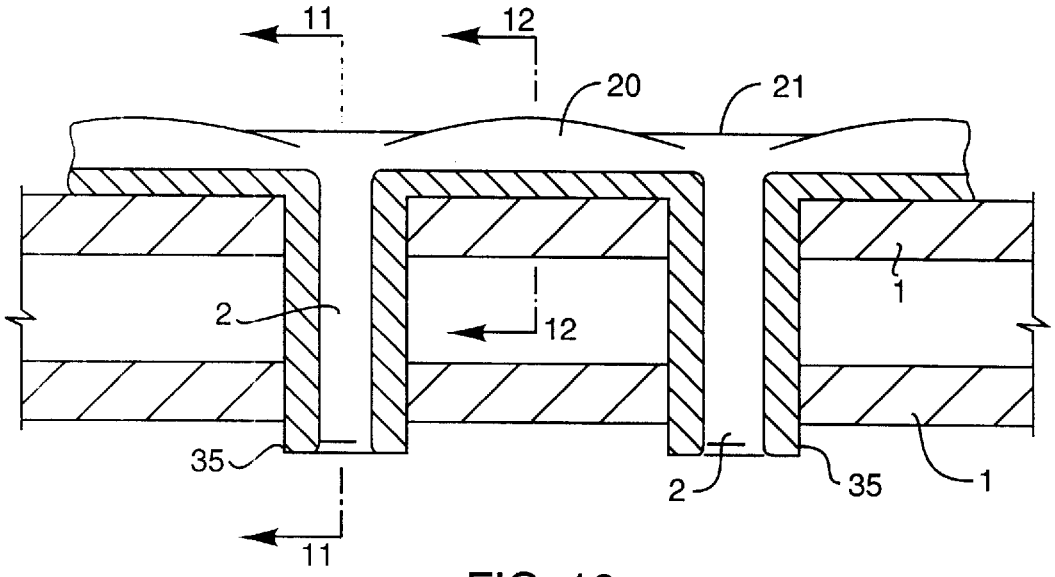
FIG. 10 is a side sectional view of a portion of a racquet frame, showing a pair of string holes with grommet strip.
Figure 11:
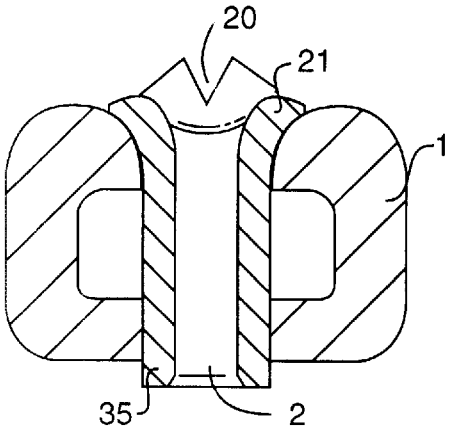
FIG. 11 is a section on 11—11 of FIG. 10.
Figure 12:
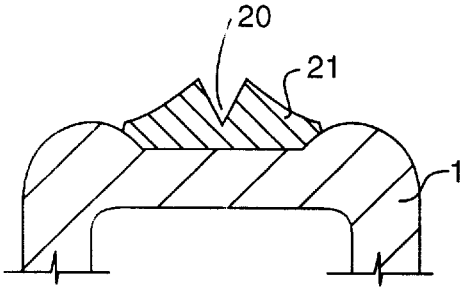
FIG. 12 is a section on 12—12 of FIG. 10.
Figure 13:
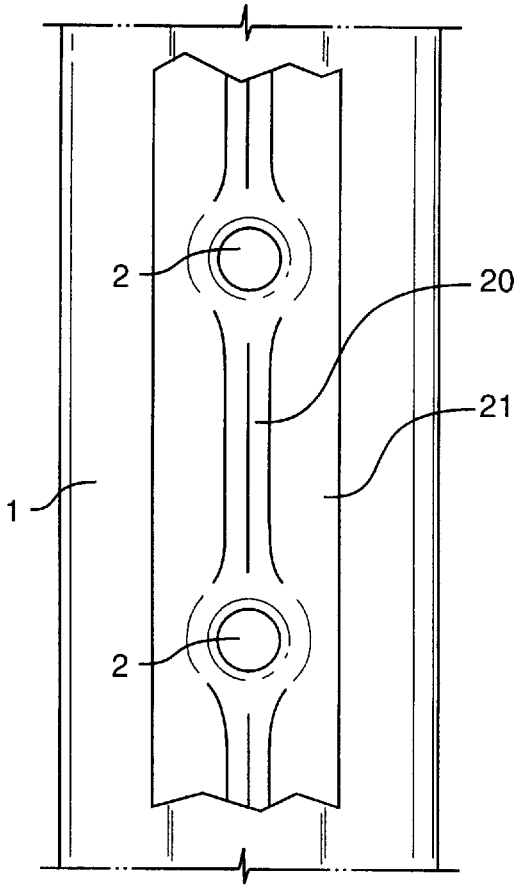
FIG. 13 is a top view of the portion of the racquet frame of FIG. 10.
Figure 14:
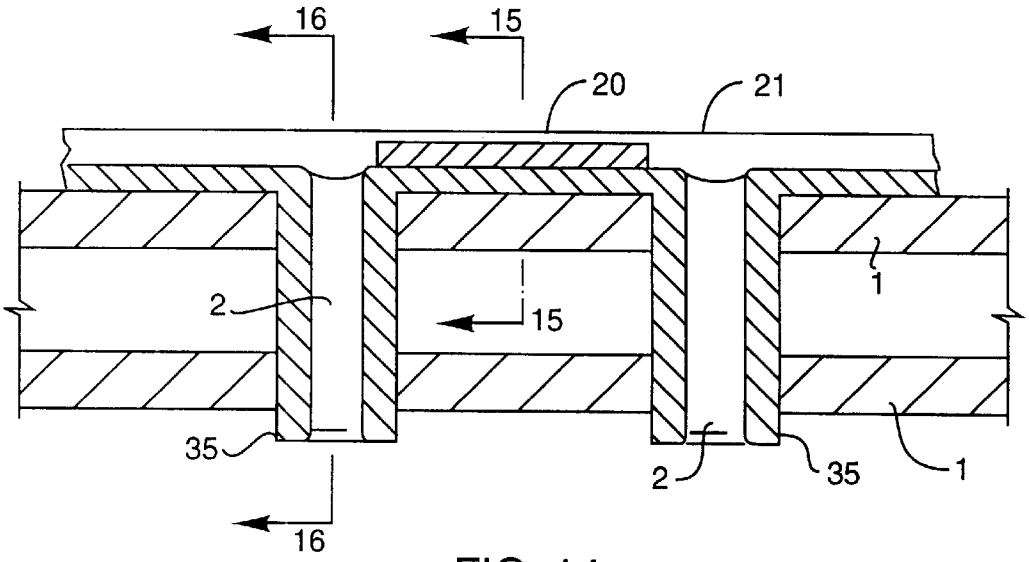
FIG. 14 is a side view of a section through a portion of a racquet frame in accordance with an embodiment of the present invention, showing a racquet with grommet strip and frictional pad.
Figure 15:
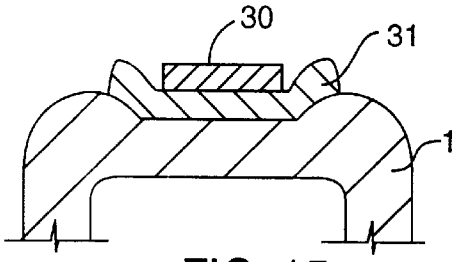
FIG. 15 is a section on 15—15 of FIG. 14.
Figure 16:
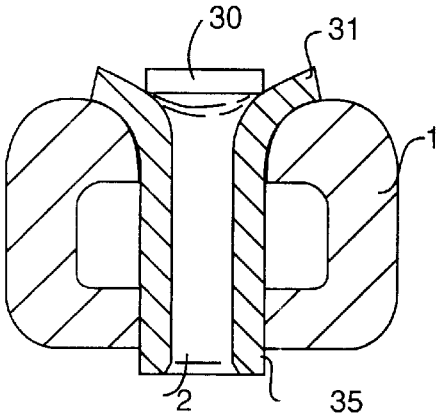
FIG. 16 is a section on 16—16 of FIG. 14.
Figure 17:
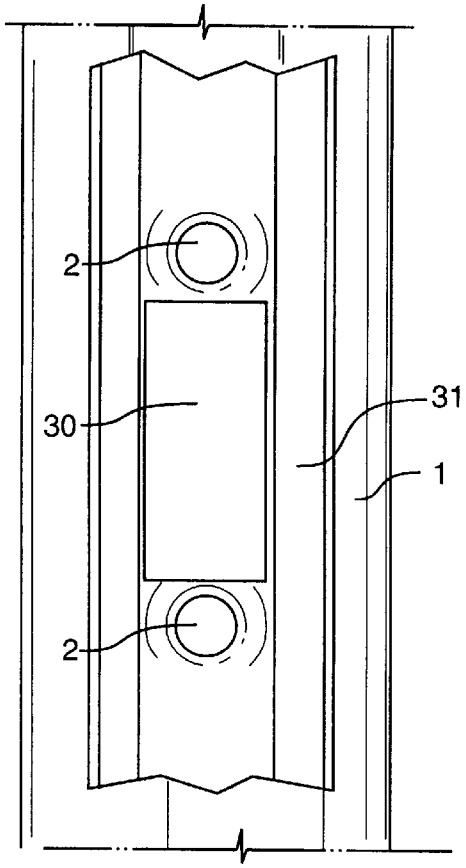
FIG. 17 is a top view of the portion of frame of FIG. 14.
Figure 18:
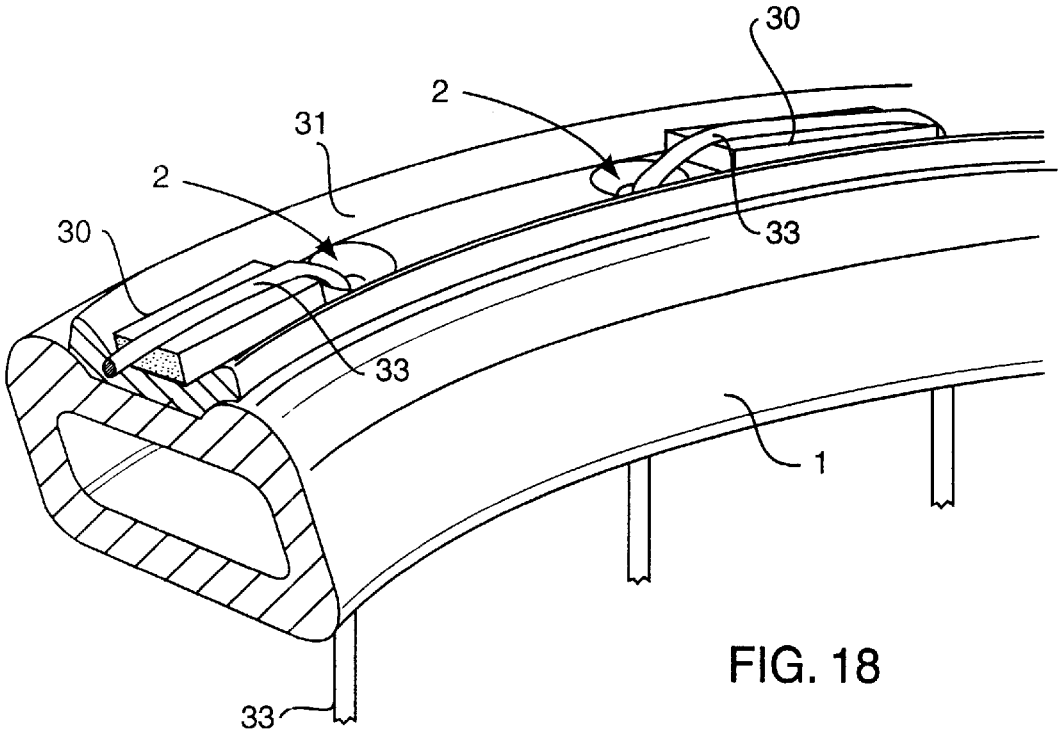
FIG. 18 is a perspective view of a portion of a racquet frame in accordance with the embodiment of FIG. 14.

As can most clearly be seen in FIGS. 10 and 11, the grommet strip 21 incorporates V shaped channel 20 (most clearly seen in FIG. 13) which runs between the string holes 2.

The locking cross-section grommet strip is intended to facilitate the application of independent tensioning to strings in a continuously strung racquet and maintenance of differential pressures between adjacent strings.

In operation, the length of stringing material will be extended between a first pair of holes to form a first string and tension applied to the predetermined tension. The continuous string length is then passed into the V shaped locking cross-section grommet 20 and into the adjacent string hole 2 and across to the opposite hole to form the adjacent string where tension will be, in turn, applied to that string. The locking grommet strip section 20 provides a high friction retention means for the continuous string length, which maintains a differential pressure between adjacent strings. Therefore, if required, different tensions may be applied to different strings.

As with the previous embodiment, therefore, different characteristics can be applied to the racquet by adjusting string tension for each string.

The locking cross-section may be provided with teeth to increase retentive capability.

Continuous stringing is preferably utilised in this arrangement. It is possible to use different string materials, however, by continuously stringing two or three strings at a time, for example, rather than continuously stringing all the strings in the racquet with one continuous string. It is therefore possible to vary the gauge and material in the strings, as in the previous embodiment.

FIGS. 14 through 18 show yet a further embodiment which discloses a holding means comprising a pad 30 of high frictional material which extends between adjacent string holes 2 about the outer surface of a racquet frame 1. The high friction pad 30 is supported on a grommet strip 31 which extends about the outer circumference of the racquet frame 1. In a similar manner to the "V" cross-section grommet strip of the previous embodiment, the high frictional pads 30 extending between adjacent holes 2 act to maintain a differential pressure in adjacent strings strung by a continuous stringing method.

An alternative is to have a grommet strip made of high frictional material, instead of the smooth plastics used for prior art grommet strips, the grommet strip passing around the entire outside surface of the frame. The high frictional material (any suitable high frictional material may be used, for example thermoplastic rubbers or EUA) will prevent or at least significantly reduce slip back of differential pressure between strings.

Note that the grommet strip of the embodiment of FIGS. 10 to 13 could also be formed from high frictional material to assist retention of differential pressures between adjacent strings.

Figure 20:
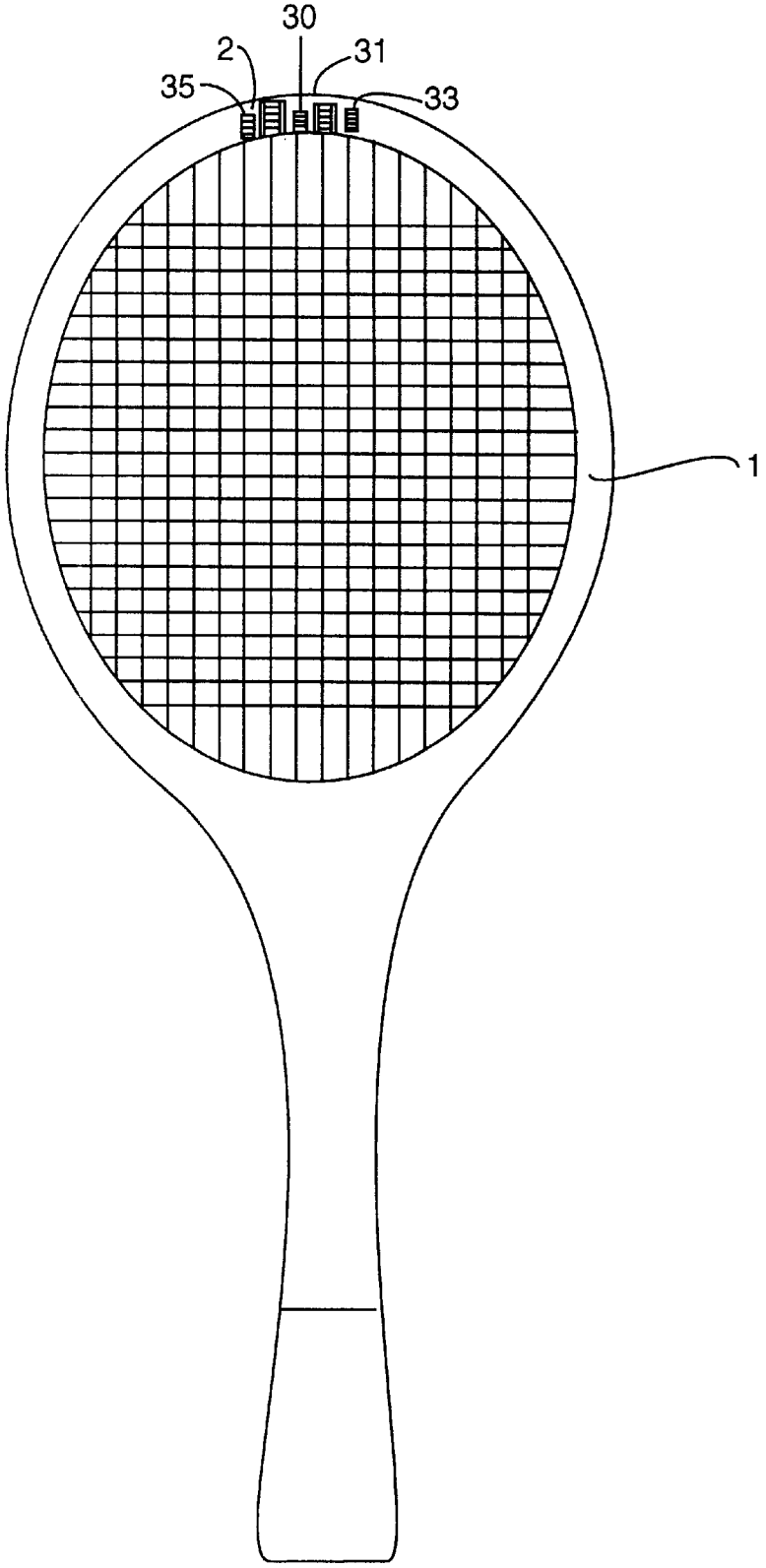
FIG. 20 is a schematic partially sectioned view of tennis racquet strung in accordance with the present invention.

FIG. 20 shows a schematic view of a racquet strung in accordance with the embodiment of FIGS. 14 through 18, with frictional pads. The view is partially sectioned to show the stringing. The same reference numerals are used as in the embodiment of FIGS. 14 through 18.

Figure 22:
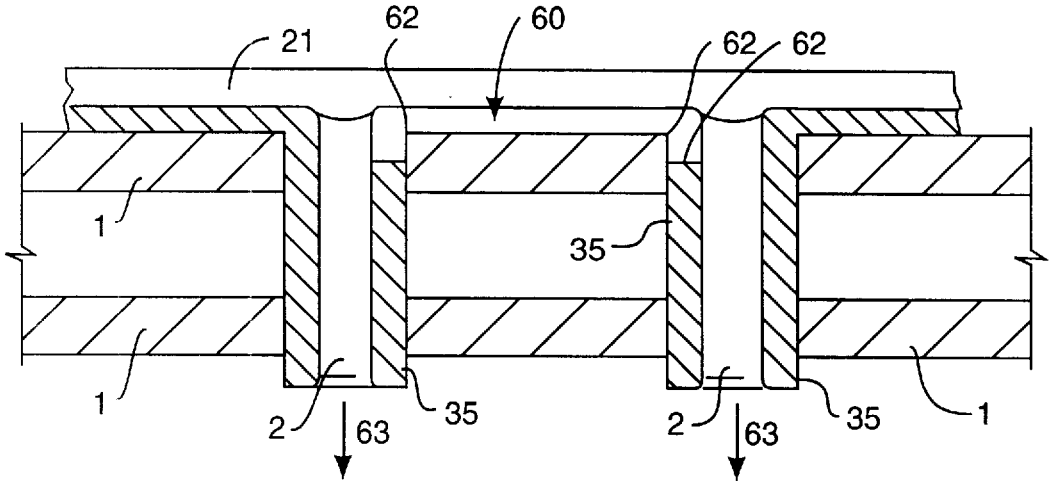
FIG. 22 is a side sectional view of a portion of a racquet frame of an alternative embodiment of the present invention, with modified grommet strip.
Figure 23:
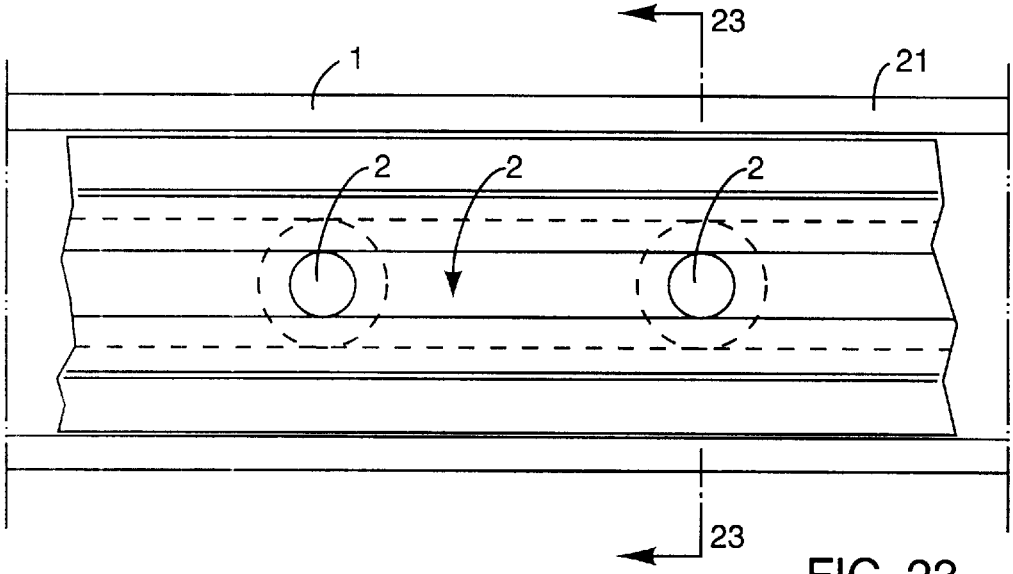
FIG. 23 is a top view of FIG. 22.
Figure 24:
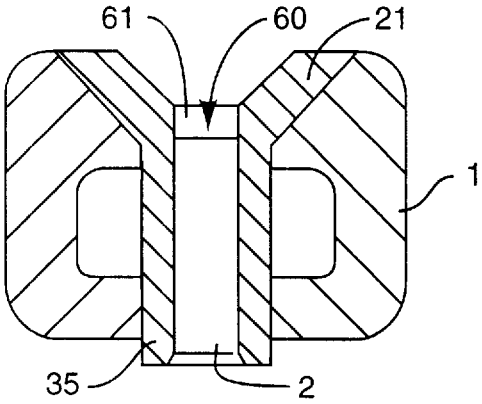
FIG. 24 is a section on 24—24 of FIG. 23.

FIGS. 22 through 24 illustrate a further alternative embodiment utilising a modified grommet strip to provide a holding means for maintaining differential pressure between adjacent independently tensioned strings in a racquet head. Portions 35 of grommet strip 21 extend into string holes in the racquet frame 2, as in previous embodiments. As is most clearly seen in figures 23 and 22, part of one side of the portion 35 is cut away at 61 in the vicinity of the outer surface of the racquet frame 1. A channel 60 is cut in the grommet strip 21 extending between adjacent cut-away portions 61 and exposing to varying degrees the outer surface of the racquet frame 1 between adjacent string holes 2. The differential tension (tension applied to each string in direction 63) between adjacent strings is maintained by the channel 60 corners 62 acting to grip the stringing material. In particular, the differential tension is held by the stringing material bending around the edges 62 of the frame.

Figure 25:
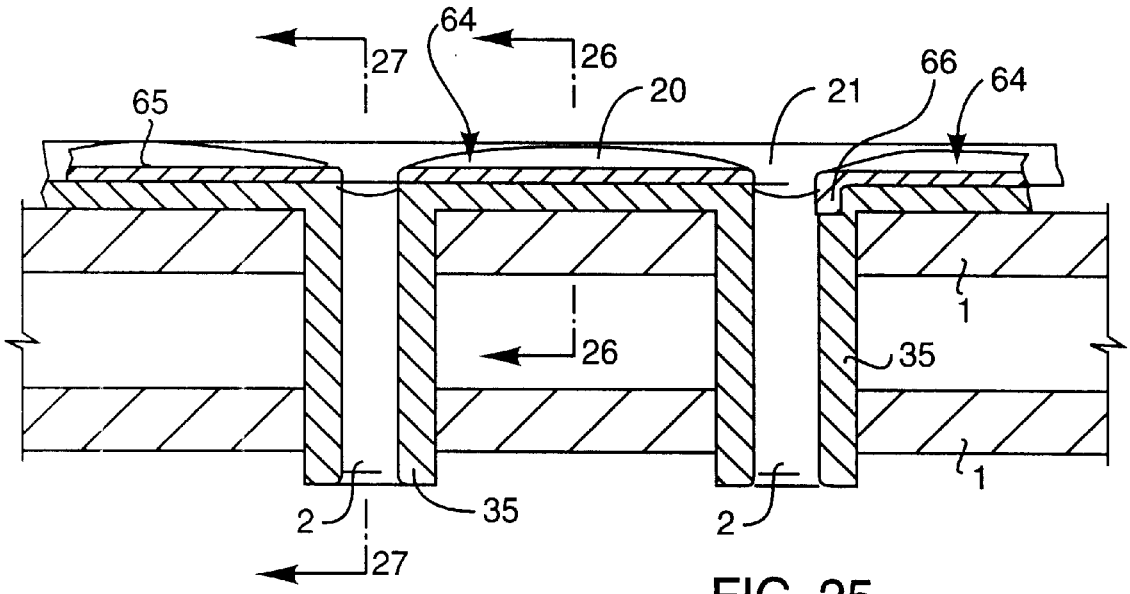
FIG. 25 is a side sectional view of a portion of a racquet frame in accordance with a further embodiment of the present invention with an alternative modified grommet strip.
Figure 26:
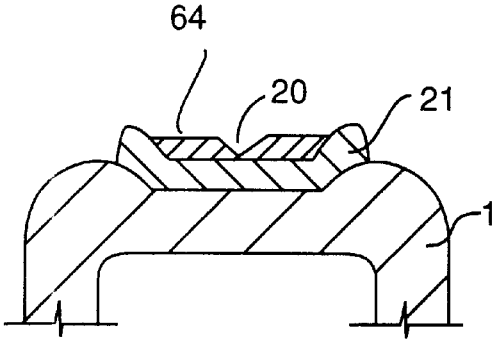
FIG. 26 is a section on 26—26 of FIG. 25.
Figure 27:
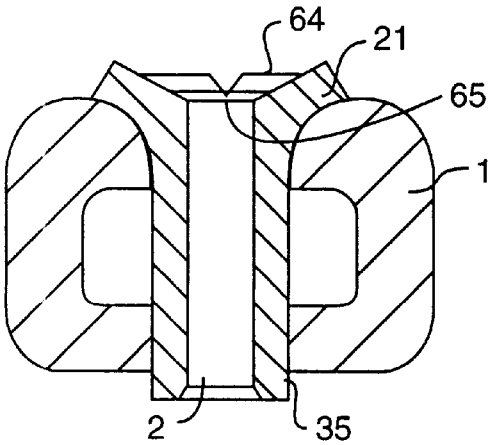
FIG. 27 is a section on 27—27 of FIG. 25.

A further alternative holding grommet-strip is illustrated in FIGS. 25 through 27. The grommet strip incorporates two separate materials fused together during manufacture. Reference numeral 35 indicates normal grommet strip material and reference numeral 64 illustrates high frictional material fused thereto. Reference numeral 65 indicates the fuse join line. As can be seen from reference numeral 66, the high frictional material may extend, in some variations, into the string hole 2.

As shown in FIG. 26, the high frictional material 64 may also include a "V" cross-section groove 20.

Figure 19:
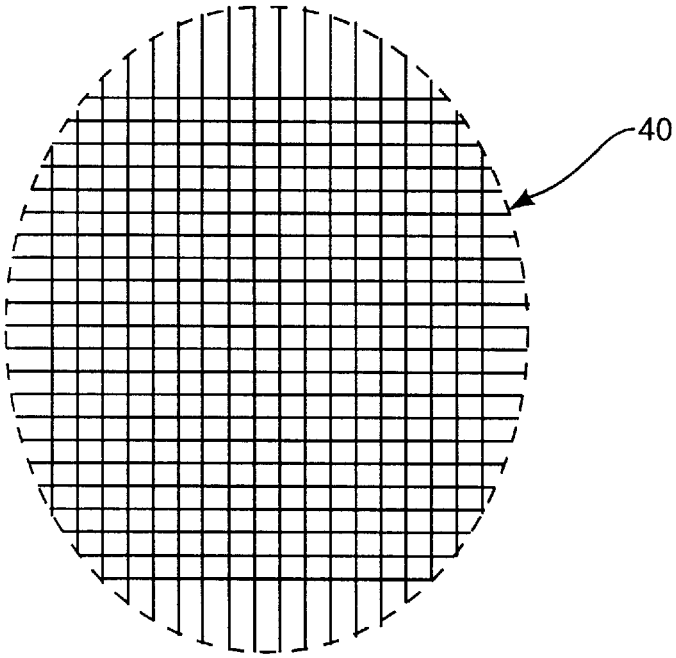
FIG. 19 illustrates a pre-woven string mesh in accordance with an embodiment of the present invention.

FIG. 19 illustrates a pre-woven mesh which lends itself to use with the method and racquet of the present invention.

The pre-woven mesh 30 is prepared by being woven in large looms by weaving machines which are presently available. The string sets are produced in a continuous stream, held in position by contact glue or sealed in position by low tack adhesive sheets or other suitable methods top and bottom of the weave. The weave is then guillotined to racquet shape (slightly larger so that the ends of the guillotined strings will project through string holes in the racquet frame) and packaged ready for insertion within a racquet.

In racquet stringing, the free ends of the weave will be placed through the strings holes in the racquet from the inside of the frame to the outside, and the ends can then be pulled to pressure. Preferably, the holding means utilised with the string set in accordance with this embodiment of the invention will comprise a plurality of cleats, each string hole having a cleat, as discussed above in relation to the embodiment of FIGS. 1 to 9.

A predetermined pressure pattern applied in accordance with embodiments of the present invention may be any desired pressure pattern. For example, it may provide a sweet spot over the entire surface of the racquet, by predetermining the tensions of the strings such that the elastic quality of the long strings is the same as the elastic quality of the shorter strings. Alternatively, different areas of the racquet may be tensioned to provide different characteristics, one area for spin, one area for power, for example.

The ability to use individual strings in various embodiments of this invention enables the possibility that different coloured strings could be used to make a predetermined pattern on the face of the racquet. This predetermined pattern could be used for advertising, sponsorship purposes, etc. Each string would be coloured before being inserted into the racquet, unlike present day pattern making which involves spraying the racquet once it has been strung.

One further problem with present day continuous stringing is that it is necessary to brace the racquet against the tension stress caused by the strings, in order to prevent implosion of the racquet frame during stringing. With the present invention, as long as stringing of the individual strings occurs in the correct order, it is not necessary to provide a brace, as the strings will compensate for applied pressures. The present invention also provides a marked racquet frame which indicates the order in which tension should be applied to the strings.

Figure 21:
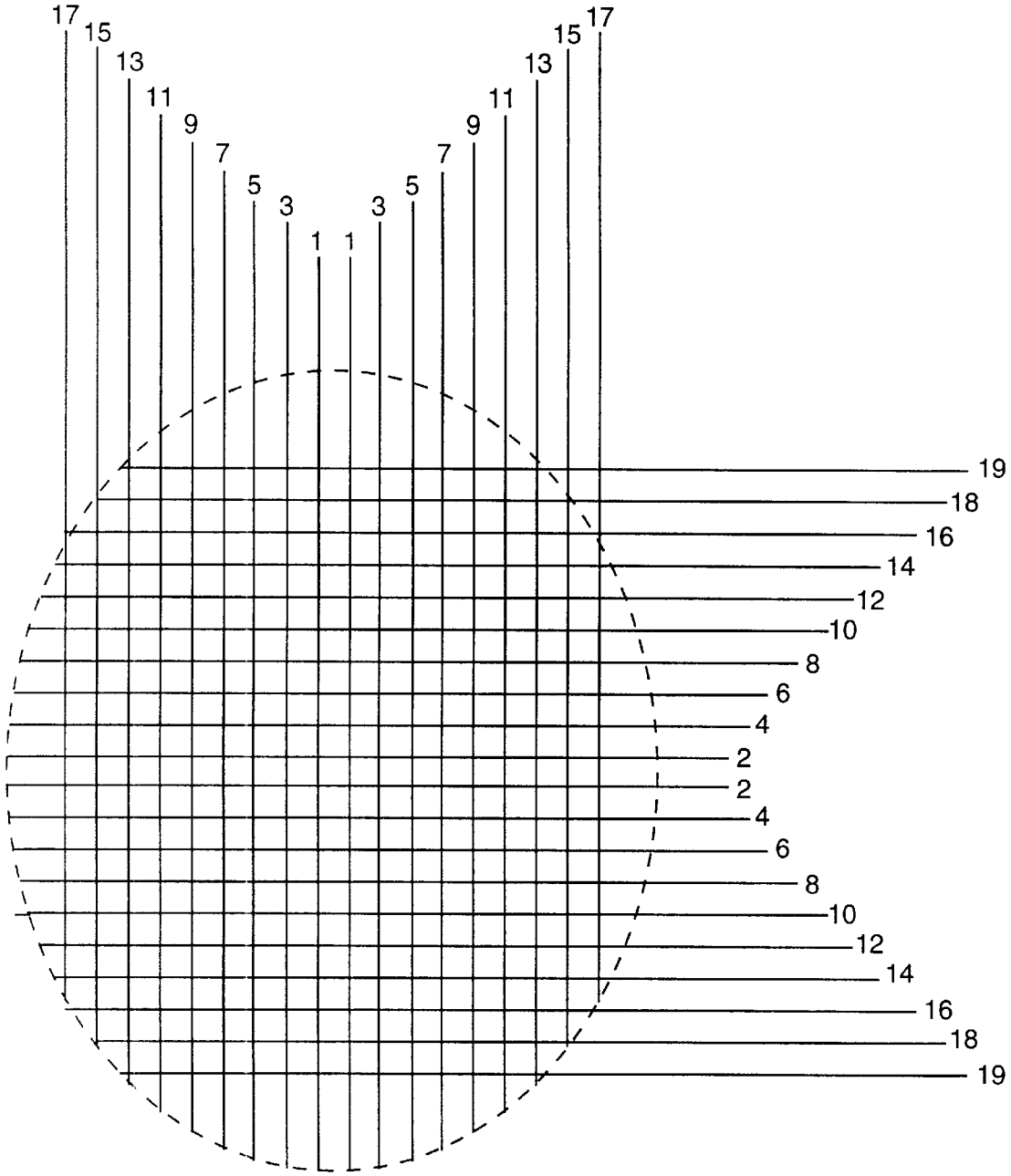
FIG. 21 is a view of a pre-woven mesh labelled to indicate a preferred order of application of tension to the strings in a racquet tensioned in accordance with the method of the present invention.

FIG. 21 illustrates the order in which tension may be applied to a racquet in accordance with a preferred embodiment of the present invention. Tensioning will be applied consecutively with the illustrated numbering. In at least a preferred embodiment, if tension is applied in this order, it will not be necessary to brace the racquet, or only minimal bracing will be required during stringing. A racquet frame may be marked with numbers, or colouring, to indicate in what order it should be tensioned.

Further, prior art continuous stringing requires various strong zones in racquet frames. This adds weight to the racquet. In some embodiments of the present invention, where the entire racquet is not strung at high tension, only the longer strings, it is possible to dispense with such frame reinforcement. This allows manufacture of lighter frames.

The frames may be designed in accordance with the pressure patterns to be applied, for racquets in accordance with the present invention. That is, the strength of the frame will be designed to suit stringing patterns and requirements for frame characteristics.

It will be appreciated that the stringing method and racquet can be used for any type of racquet, e.g., squash, badminton, tennis, racquet ball etc.

Present day racquets may be adapted to utilise stringing in accordance with the present invention. For example, utilising a locking grommet strip, it is easy to adapt presently available racquets. If cleats are required to be used with present racquets, it may be necessary to drill out string holes and make them wider, but it may be done (or, alternatively, mount cleats on the outside of the racquet frame.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A method of stringing a racquet, comprising the steps of independently tensioning at least a plurality of strings in the racquet to predetermined tensions and applying means for maintaining the independent tensioning, wherein the strings are continuously strung, and wherein each individual string of at least the plurality of strings is independently tensioned against and the tension is maintained by a holding means, the holding means comprising a plurality of cleats into which the strings may be locked, the cleats being mounted to a racquet frame, the cleats being V-Jam cleats, comprising opposing side walls defining an open top, the walls approaching each other from the opening towards the bottom of the walls.

2. A method of stringing a racquet according to claim 1, wherein plurality of cleats fixed relative to the racquet frame, each string is strung between a pair of the cleats.

3. A method of stringing a racquet in accordance with claim 2, the step of tensioning each string comprising locking one end of the string in a first of a pair of the cleats, applying tension to the other end of the string until the string is tensioned to a predetermined level, and then locking the other end of the string in the second of the pair of cleats.

4. A method of stringing a racquet in accordance with claim 2, comprising the step of tensioning each string by applying pressure to the string until the string is tensioned to a predetermined level and then locking each end of the string within each of the pair of the cleats.

5. A method of stringing a racquet in accordance with claim 2, wherein the cleats are held by a grommet strip within string holes in the frame of the racquet.

6. A method of stringing a racquet in accordance with claim 2, wherein the cleats are integral with the racquet frame.

7. A method of stringing a racquet in accordance with claim 1, wherein the strings are individual strings.

8. A method of stringing a racquet in accordance with claim 1, wherein the strings are strung by a mixture of continuous and individual stringing.

9. A method of stringing a racquet in accordance with claim 1, wherein the strings are provided as a pre-woven mesh, and wherein the method comprises the step of fitting pre-woven mesh into a racquet frame, tensioning the strings and maintaining the string tension in the frame.

10. A method of stringing a racquet in accordances with claim 9, wherein the step of tensioning the strings comprises adjusting the tension of at least a plurality of the strings at the same time.

11. A method of stringing a racquet in accordance with claim 1, the method comprising the steps of applying tension to the racquet strings in order to implement a predetermined pressure pattern over the face of the racquet.

12. A sports racquet, strung in accordance with the method of claim 1.

13. A method in accordance with claim 1, wherein a teeth are provided projecting from the walls of the cleat, the teeth operating to grip a racquet string to tension.

14. A method in accordance with claim 13, wherein there is a pair of opposing teeth.

15. A method in accordance with claim 14, wherein there are a plurality of pairs of opposing teeth.

16. A method in accordance with claim 13, wherein the cleats are arranged to be self-locking, whereby the tension of a racquet string acts against the cleat teeth causing the string to slide further into the angle of the opposing walls to be locked to tension.

17. A method in accordance with claim 16, wherein the teeth comprise angled projections projecting from the opposing walls of each cleat, and lying at an angle so that the foot of the projection, further within the cleat, is displaced from the top of the projection, at the opening of the cleat, and, in operation, the cleats are mounted within the racquet so that the teeth angle backwardly from the bottom of the walls to the top in the opposite direction to the direction of tension applied by the strings.

18. A sports racquet frame in accordance with claim 17, wherein there are four or more pairs of opposing teeth.

19. A method of stringing a racquet, comprising the steps of independently tensioning at least a plurality of strings in the racquet to predetermined tensions and applying means for maintaining the independent tensioning, wherein the strings are strung by a mixture of continuous and individual stringing, and wherein each individual string of at least the plurality of strings is independently tensioned against and the tension is maintained by holding means, the holding means comprising a plurality of cleats into which the strings may be locked, the cleats being mounted to a racquet frame, the cleats being V-jam cleats, comprising opposing side walls defining an open top, the walls approaching each other from the opening towards the bottom of the walls.

20. A method of stringing a racquet according to claim 19, wherein the holding means comprises a plurality of cleats fixed relative to the racquet frame, and each string is strung between a pair of the cleats.

21. A method of stringing a racquet in accordance with claim 20, the step of tensioning each string comprising locking one end of the string in a first of a pair of the cleats, applying tension to the other end of the string until the string is tensioned to a predetermined level, and then locking the other end of the string in the second of the pair of cleats.

22. A method of stringing a racquet in accordance with claim 20, comprising the step of tensioning each string by applying pressure to the string until the string is tensioned to a predetermined level and then locking each end of the string within each of the pair of the cleats.

23. A method of stringing a racquet in accordance with claim 20, wherein the cleats are held by a grommet strip within string holes in the frame of the racquet.

24. A method of stringing a racquet in accordance with claim 20, wherein the cleats are integral with the racquet frame.

25. A method of stringing a racquet in accordance with claim 19, wherein the strings are continuously strung.

26. A method of stringing a racquet in accordance with claim 19, wherein the strings are individual strings.

27. A method of stringing a racquet in accordance with claim 19, wherein the strings are provided as a pre-woven mesh, and wherein the method comprises the step of fitting pre-woven mesh into a racquet frame, tensioning the strings and maintaining the string tension in the frame.

28. A method of stringing a racquet in accordance with claim 27, wherein the step of tensioning the strings comprises adjusting the tension of at least a plurality of the strings at the same time.

29. A method of stringing a racquet in accordance with claim 19, the method comprising the steps of applying tension to the racquet strings in order to implement a predetermined pressure pattern over the face of the racquet.

30. A sports racquet, strung in accordance with the method of claim 19.

31. A method in accordance with claim 19, wherein a teeth are provided projecting from the walls of the cleat.

32. A method in accordance with claim 19, wherein there is a pair of opposing teeth.

33. A method in accordance with claim 32, wherein there are a plurality of pairs of opposing teeth.

34. A method in accordance with claim 31, wherein the cleats are arranged to be self-locking, whereby the tension of a racquet string acts against the cleat teeth causing the string to slide further into the angle of the opposing walls to be locked to tension.

35. A method in accordance with claim 34, wherein the teeth comprise angled projections projecting from the opposing walls of each cleat, and lying at an angle so that the foot of the projection, further within the cleat, is displaced from the top of the projection, at the opening of the cleat, and, in operation, the cleats are mounted within the racquet so that the teeth angle backwardly from the bottom of the walls to the top in the opposite direction to the direction of tension applied by the strings.

36. A sports racquet frame in accordance with claim 35, wherein there are four or more pairs of opposing teeth.

* * * * *